United States Patent [19]

Ferrari et al.

[11] Patent Number: 4,732,383

[45] Date of Patent: Mar. 22, 1988

[54] SHOCK AND VIBRATION ABSORBER FOR RACQUETS AND METHOD FOR ITS USE

[75] Inventors: Harry Ferrari; Raymond P. Harrington; Harry W. Ingram, all of Pittsburgh, Pa.

[73] Assignee: Ferrari Importing Company, Royal Oak, Mich.

[21] Appl. No.: 853,983

[22] Filed: Apr. 21, 1986

[51] Int. Cl.[4] ..... A63B 49/00

[52] U.S. Cl. ..... 273/73 D; 273/DIG. 8

[58] Field of Search ..... 273/73 R, 73 D, 73 C, 273/29 R, 29 A, 58 R, 58 A, 58 BA, 67 R; 124/90, 92; 49/9; 84/234, 255, 216; 128/152, 151; 604/358; 174/42; 248/562, 636; 181/207, 208; 428/316.6, 314.4, 314.8

[56] References Cited

U.S. PATENT DOCUMENTS

| | | | |
|---|---|---|---|
| 2,732,209 | 1/1956 | Forbes | 273/73 R |
| 3,899,172 | 8/1975 | Vaughn et al. | 273/73 H X |
| 3,941,380 | 3/1976 | Lacoste | 273/73 R |
| 4,180,265 | 12/1979 | Staufer | 273/73 D |
| 4,330,125 | 5/1982 | Sassler | 273/73 C |
| 4,353,551 | 10/1982 | Ariech | 273/73 R |
| 4,364,564 | 12/1982 | Lewis | 273/29 R |
| 4,509,750 | 4/1985 | Last | 273/29 A |
| 4,575,083 | 3/1986 | Adam | 273/73 D |
| 4,609,194 | 9/1986 | Krent et al. | 273/73 D |

FOREIGN PATENT DOCUMENTS 3123690 3/1983 Fed. Rep. of Germany .... 273/73 R

*Primary Examiner*—Matthew L. Schneider

*Attorney, Agent, or Firm*—Hymen Diamond

[57] ABSTRACT

Shock and vibration is suppressed in a racquet having a tubular frame of metal, graphite, fiberglass, or the like, by a bar or column of shock-and-vibration-absorbing material such as foam. The bar is 5 inches to 10 inches in length and is weaved over and under the vertical strings in the region, between the handle and the nearest cross or horizontal string, where a ball or shuttlecock would not impact in normal play. The ends of the bar are brought through the end spaces between the string and the frame of the racquet and tucked under the frame. The bar is composed of layers of the shock-and-frequency absorbing material. The material is soft, light and resilient. The inner layer or layers has a higher density than the outer layer. The frequency for which the maximum absorption occurs decreases progressively from the inner layer or layers outwardly. The resonant frequency of a typical racquet is about 650 hertz. The predominant absorption frequency of the outer layers of the bar is between 500 and 2000 hertz. The inner layer of layers, being of higher density, have maximum absorption at higher frequency and predominantly absorb shock while the outer layers predominantly absorb vibration.

3 Claims, 5 Drawing Figures

FIG.1
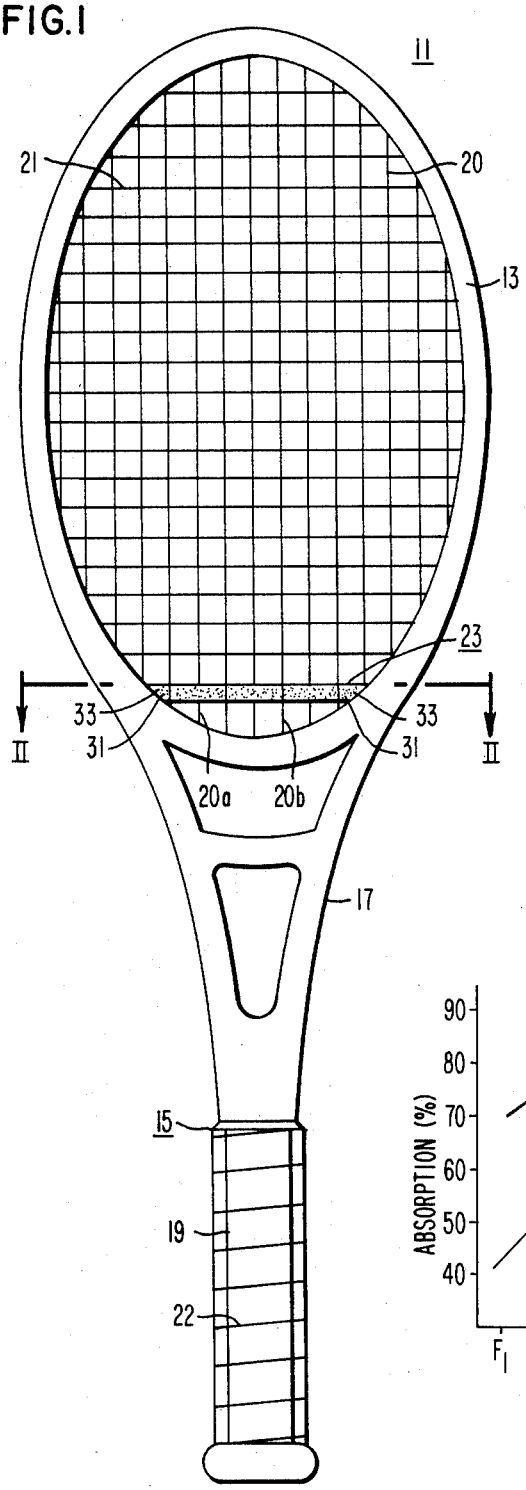
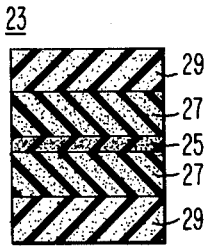
FIG.4
FIG.5
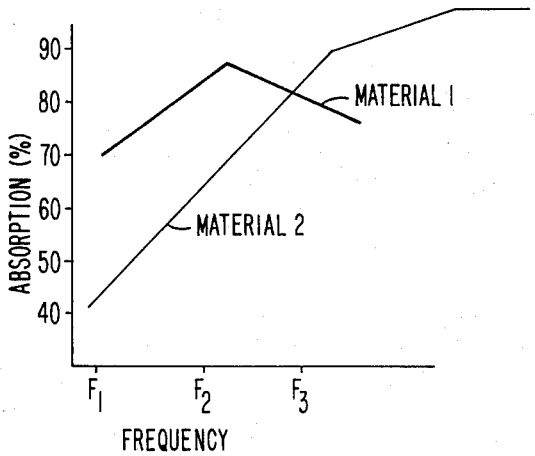

SHOCK AND VIBRATION ABSORBER FOR RACQUETS AND METHOD FOR ITS USE

BACKGROUND OF THE INVENTION

This invention relates to sports racquets used in playing tennis, squash, racquetball or badminton. It has prticular relationship to racquets constructed of materials other than wood, for example, materials of metal, graphite, fiberglass, or the like. Wood is a natural dampening material and when the frame of a racquet constructed of wood is struck by a ball or shuttlecock, the shock transmitted to the player and the vibration is minimal and the racquet has a desirable feel for the player. In the use of the tubular racquets, the shock and vibration is substantially more intense. The vibration is at higher frequencies in the audible range and can be heard by the player. In some cases the level of shock and vibration is so severe as to cause arm, elbow and shoulder discomfort to the player. It is an object of this invention to suppress the shock and vibration which occurs in use in play of a racquet whose frame and handle are of the above-described tubular type.

In accordance with the teachings of the prior art, attempts have been made to suppress the shock and vibration by connecting the center vertical strings near the handle by means of a washer or other plug. As used in this application, the expression "vertical strings" means the strings of a racquet which are parallel to the handle. The strings which interlace with the vertical strings are referred to in this application as "horizontal strings" or "cross strings". Typical plugs of this prior art type are sold by Donnay of West Lebanon, N.H., USA under the trademark "VIBRAZORB". As taught by Donnay's literature, the plugs may also be inserted between strings in other areas of the periphery of the face of the racquet than near the handle. The disadvantage of this prior art expedient is that during play, the plugs become dislodged by the impact of the ball on the strings. In addition, the plugs are not effective in suppressing shock and vibration.

It is an object of this invention to overcome the disadvantages of the prior art and to provide apparatus and a method for the suppression of shock and vibration in the use of a tubular racquet in play which apparatus in use shall not become dislodged from the racquet and which apparatus in use and which method in practice shall effectively suppress shock and vibration. It is also an object of this invention to provide a racquet of the tubular type in whose use in play shock and vibration shall be suppressed.

SUMMARY OF INVENTION

In accordance with this invention, there is provided a bar or column of foam of shock-and-vibration absorbing material which is mounted on the vertical strings of the racquet in the region which is not normally impacted by the ball in play, specifically, between the handle and the nearest horizontal string. The bar is mounted on the racquet by weaving the bar over and under alternate vertical strings in the region between the handle and the nearest horizontal string. At each end the bar is brought through the space bounded by the frame of the racquet, the nearest vertical string and the intersecting nearest horizontal string and is tucked under the frame. The boundary of this space is generally a small triangle. The bar is composed of soft resilient material and can be readily deformed and pulled through the small triangular spaces so that it can be tucked under the frame. The bar is composed of a plurality of layers of the shock and vibration absorbing materials. The materials of the layers are selected so that the frequency for which each layer has the maximum absorption decreases from a higher to a lower magnitude progressively, or in two steps, from the inside layer of the bar outwardly. Suitable materials for use in the bar are sold under the trademark "PORON" by Rogers Corporation, Box 158, East Woodstock, CT 06244 and under the trademark "SCOTTFOAM" or "SCOTTFELT" by SCOTTFOAM, 1500 East Second St., Eddystone, PA 19013. Suitable materials are also available from other organizations. The materials of the outer layers of the bar should be so selected that they have a maximum absorption for vibration frequencies in the range of frequencies between 500 and 2000 hertz. The inner layer or layers should be of a material having a maximum absorption for substantially higher vibration frequencies. Essentially, the outer layers predominantly suppress vibration and the inner layer or layers predominantly suppress shock. A multi-layer bar whose layers have maximum absorption frequencies related differently than described above are also within the scope of this invention. For example, the outer layers may have a higher frequency of maximum absorption than the inner layer or layers.

The bar, woven above and below alternate vertical strings, is firmly secured to the racquet and does not become dislodged during play. To control the level of absorption of vibrations, the bar can be set nearer the handle for reduced vibration absorption, or nearer the horizontal string nearest the handle for higher vibration absorption.

By contacting vertical strings from one edge of the racquet to the other, the bar also suppresses wave propagation through the racquet frame. By eliminating the ringing associated with striking a ball with a tubular frame, the player can better isolate the feel of the initial contact with the ball and ignore the after shock and ringing that is normally present. The contact of the ends of the bar with the frame also reduces the transmission of shock and vibration through the frame to the handle.

BRIEF DESCRIPTION OF THE DRAWINGS

For a better understanding of this invention, both as to its organization and as to its method of operation, together with additional objects and advantages thereof, reference is made to the following description taken in connection with the accompanying drawings, in which:

FIG. 1 is a plan view of a racquet embodying this invention;

FIG. 4 is a view in section taken along line IV—IV of FIG. 3; and

FIG. 5 is a graph for aiding in the explanation of an aspect of this invention.

DETAILED DESCRIPTION OF EMBODIMENTS AND PRACTICE OF INVENTION

Figure 3:
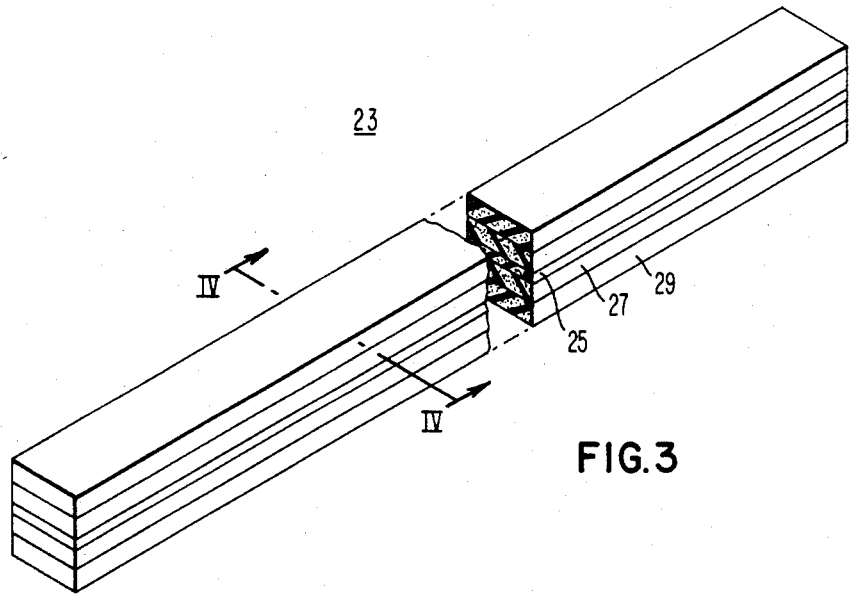
FIG. 3 is a view in isometric showing a shock-and-vibration absorbing bar in accordance with this invention used in the practice of the method of this invention.
Figure 2:
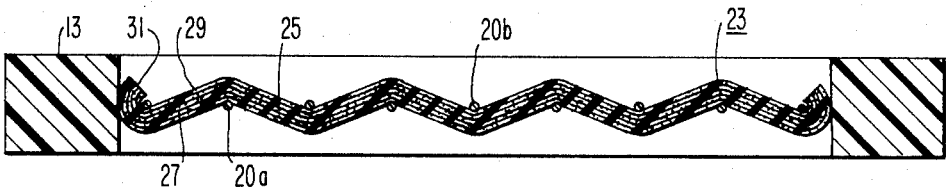
FIG. 2 is a view in section taken along line II—II of FIG. 1.

FIG. 1 shows a tennis racquet 11 having a tubular skeleton including the frame 13 and the handle 15. The handle 15 includes the neck 17 and the grip 19. The skeleton is molded from a material such as metal, graphite, fiberglass, or other like material and is tubular. The tubular structure may be hollow or it may be filled with a foam or like material. The frame 13 is of tubular rectangular transverse cross-section with its sides perforated to receive the vertical string 20 and the horizontal or cross strings 21 which are threaded through the frame and tensioned. The neck 17 is also of tubular, generally rectangular, transverse cross-section. The grip 19 includes an inner member (not shown) of rectangular transverse cross-section, which is molded integral with the frame 13 and neck 15, and which is wrapped in a helically wound tape 22 of leather or a leather-substitute. The grip 22 is wrapped in such a way that it has an octagonal transverse cross-section.

To suppress shock and vibration in play, the racquet 11 is provided with a shock-and-vibration absorbing bar 23 of light, soft, resilient foam. Typically, this bar is of square transverse cross-section 5 to 10 inches long, depending on the dimensions of the racquet in which it is mounted and 3/8 to 13/16-inch wide and deep. Typically, the bar 23 is composed of a plurality of layers of different foams. In the embodiment shown in the drawings, the bar 23 has a central layer 25 (FIG. 4) on each surface of which layers 27 and 29 are stacked. The central layer 25 is of a material such, and is dimensioned so, that the vibration for which it has maximum absorption is higher. The layers 27 and 29 are each composed of opposite members of like material and dimensions. The vibration for which layer 27 has the maximum absorption frequency is substantially lower than the maximum frequency for layer 25. The vibration for which layer 29 has the maximum absorption frequency may be the same as, or lower than, the frequency for the layer 27. Additional layers may be stacked on layers 29 and their absorption frequency may decrease as the position of the layers recedes from the center. The outer surfaces of layers 29 may be covered by a protective material. Typically, the layer 25 may have a thickness of 1/16-inch and may be composed of Rogers "PORON" high-density cellular urethane, layers 27 may have a thickness of 3/16-inch each and may be composed of Rogers RFF-263 foam; and layer 29 may also have a thickness of 3/16-inch each and may be composed of Rogers REF-1734 foam. "SCOTTFOAM", specifically SCOTTFELT, may also be used.

To secure the bar 23 to the racquet 11, the bar is woven over and under alternate vertical strings **20*a* and 20*b* in the region between the handle 15 and the horizontal string 21*a* nearest the handle 15. The ends 31 of the bar 23 are passed through the triangular space 33 at each end, which is bound by the portions of the strings 20*b* and 21*a* at the ends and the portions of the frame 13 subtended by the portions of the strings, and tucked under the frame 13. Shock and vibration in play is suppressed by the dampening effect of the bar 23 on the strings 20 and 21 and on the frame 13**.

The vibration frequencies to be suppressed may be determined from the properties of the strings 20 and 21 in the racquet 13. The fundamental $f_1$ of the resonant frequency is given by the equation:

$$f_1 = \frac{1}{2L}\sqrt{\frac{F}{\mu}}$$

where:

L=string length,

F=tension force in strings, and $\mu$=mass of strings per unit length.

For a tennis racquet with typical stringing:

L=0.3 meters,

F (applied)=60 pounds=267 newtons, $\mu$=0.00144 kilograms per meter, and $f_1$=728 cycles/sec, in other words, about 700 hertz in a midsize racquet. The tension of 60 pounds is the tension applied. The actual tension is about 85% of 60 pounds. On this basis, $F_1$ is about 650 hertz. The Rogers RFF-263 foam, of which layers 27 of bar 23 are typically composed, and the REF-1734 of which layers 29 of bar 23 are typically composed, manifest an absorption characteristic of about 50% in the range between 500 hertz and 2000 hertz for the typical dimensions given above. The absorption characteristic may be changed by changing the position of the bar on the racquet. Higher density foams such as SCOTTFOAM's "SCOTTFELT" and Roger's "PORON", of which layer 25 of bar 23 is typically composed, manifest wider range vibration frequency absorption, particularly in the higher frequencies. These higher density foams serve predominantly to absorb impact energy. Layer 25 of bar 23 serves predominantly to suppress the impact energy (shock), while layers 27 and 29 predominantly suppress vibration.

FIG. 5 is a graph showing how the absorption varies as a function of the harmonics of vibrations produced in a racquet. Frequency is plotted horizontally and absorption in percent of the impressed vibration vertically. The curve labeled "Material 1" presents the absorption as a function of frequency for a lighter foam such as Rogers REF-1734 and/or RFF-263. The curve labeled "Material 2" presents the absorption-frequency function of Rogers "PORON", a higher density material. The frequency $f_1$ is the fundamental of the vibration, $f_2$ and $f_3$ are harmonics. For the lighter foam, the absorption is greater than 70% throughout. The absorption for the foam of higher density is low for the fundamental, but increases with frequency and is high at the harmonic frequencies $f_2$ and $f_3$.

While preferred embodiments of this invention have been disclosed herein, many modifications thereof are feasible. This invention should not be restricted, except insofar as is necessitated by the spirit of the prior art.

We claim:

1. An elongated bar of shock-and-vibration absorbing material for suppressing shock and vibration in the use in play of a racquet, said racquet having a frame, vertical strings strung to the frame, and a hitting area, said bar to be weaved over and under the vertical strings of the racquet at a position located only in an edge area of said hitting area at which position said bar would not normally be impacted by a properly struck ball, said bar being composed of stacked layers of elongated strips of different materials, at least one strip, constituting an inside layer of said bar, predominantly suppressing shock and other strips, constituting layers outwardly of said at-least-one strip in said bar, predominantly suppressing vibration, the material of said outward layers being such that its predominant absorption of vibration is in a first range of frequencies, the material of said inner layer being such that its predominant absorption of vibration is in a second range of frequencies, said second range of frequencies being substantially higher than said first range of frequencies.

2. The method of conditioning a racquet to suppress shock and vibration during use in play, said racquet having a frame, vertical and horizontal strings strung on said frame forming a stringed surface, a hitting area on said stringed surface and a handle, said frame and handle being tubular and being composed of metal, graphite or fiberglass; the said method comprising: selecting a region of said stringed surface located only in an edge area of said hitting area, which edge area would not normally be contacted by a properly hit ball during play, said region being bounded by at least one horizontal string and being traversed only by vertical strings, said region terminating at its ends near said frame by generally triangular openings, each triangular opening being defined by a section of said at-least-one horizontal string, by a section of a vertical string intersecting said at-least-one horizontal string, and by the section of said frame subtending the angle formed between said section of said at-least-one horizontal string and by said section of said vertical string, the said method being further characterized by the steps of weaving an elongated bar of shock and vibration absorbing material over and under said traversing vertical strings in said region, passing the ends of said bar through said triangular openings, and tucking said ends of said bar at each end under said frame so as to contact said frame, the said contact contributing to the suppression of the vibration of said racquet.

3. The method of conditioning a racquet to suppress shock and vibration during play, said racquet having a frame, vertical and horizontal strings strung on said frame forming a stringed surface, a hitting area on said stringed surface, and a handle, said frame and handle being composed of metal, graphite or fiberglass; the said method comprising: selecting a region of said stringed surface located near said frame only in an edge area of said hitting area, which edge area would not normally be contacted by a properly hit ball during play, said region being bounded by at least one horizontal string and being traversed only by vertical strings, the method further comprising the steps of weaving an elongated bar of shock-and-vibration absorbing material over and under the vertical strings in said region, choosing a particular level of vibration absorption desired and moving the woven elongated bar along the vertical strings in a direction away from said handle for increasing the amount of vibration absorbed or moving the elongated bar along the vertical strings in a direction toward said handle for reducing the amount of vibration absorbed until the desired level of vibration absorption is reached.

* * * * *